US006598751B2

(12) United States Patent
McNelis et al.

(10) Patent No.: US 6,598,751 B2
(45) Date of Patent: Jul. 29, 2003

(54) ITEM HOLDER

(75) Inventors: Romaine McNelis, Nyack, NY (US); John McNelis, Brookeville, MD (US)

(73) Assignee: M. Romaine McNelis, Nyack, NY (US)

( * ) Notice: Subject to any disclaimer, the term of this patent is extended or adjusted under 35 U.S.C. 154(b) by 0 days.

(21) Appl. No.: 09/895,849

(22) Filed: Jun. 29, 2001

(65) Prior Publication Data

US 2002/0088761 A1 Jul. 11, 2002

Related U.S. Application Data

(60) Provisional application No. 60/214,969, filed on Jun. 29, 2000.

(51) Int. Cl.[7] ..... A47F 7/00

(52) U.S. Cl. ..... 211/13.1; 211/85.1; 211/88.01

(58) Field of Search ..... 211/13.1, 85.1, 211/85.13, 88.01; D6/450, 453, 524, 564

(56) References Cited

U.S. PATENT DOCUMENTS

| | | | | | |
|---|---|---|---|---|---|
| 892,238 | A | * | 6/1908 | Fay | |
| 2,102,643 | A | | 12/1937 | Pellegrini | |
| 2,196,566 | A | | 4/1940 | Sabattis | |
| D134,046 | S | | 10/1942 | Wilkinson | |
| D144,851 | S | | 5/1946 | Frohman | |
| D154,993 | S | * | 8/1949 | Crothers | |
| 3,101,557 | A | | 8/1963 | Watlington et al. | |
| 3,220,788 | A | * | 11/1965 | Hunckler | |
| 3,610,486 | A | | 10/1971 | Kunzmann et al. | |
| 3,718,260 | A | | 2/1973 | Sharp | |
| 3,843,031 | A | | 10/1974 | Oh et al. | |
| 3,924,750 | A | | 12/1975 | Dunchock | |
| 3,986,756 | A | * | 10/1976 | Kranich | |
| 4,002,241 | A | * | 1/1977 | Parrilla, Sr. | 211/88.01 |
| 4,162,544 | A | * | 7/1979 | Freeman et al. | |
| 4,211,331 | A | | 7/1980 | Salmon et al. | |
| D275,466 | S | | 9/1984 | Davis | |
| 4,471,077 | A | | 9/1984 | Lange | |
| 5,048,903 | A | * | 9/1991 | Loblein | |
| 5,184,718 | A | | 2/1993 | Albert | |
| D337,467 | S | * | 7/1993 | Schmidt | |
| 5,337,907 | A | * | 8/1994 | McKenzie et al. | 211/88.01 |
| D351,788 | S | | 10/1994 | Love | |
| D357,701 | S | | 4/1995 | White | |
| D361,235 | S | | 8/1995 | Decker | |
| D402,840 | S | * | 12/1998 | Servis | D6/553 |
| 5,941,623 | A | * | 8/1999 | Linehan | 211/88.01 |
| 6,059,122 | A | * | 5/2000 | Cartmell | 211/13.1 |

* cited by examiner

*Primary Examiner*—Robert W. Gibson, Jr.
(74) *Attorney, Agent, or Firm*—Gray Cary Ware & Freidenrich LLP

(57) ABSTRACT

A holder for items such as eyeglasses, dentures and hearing aids is disclosed wherein the compartments for each item may be identified. The holder may also list information about the person that owns the necessary items so that any misplaced may be more easily located.

7 Claims, 7 Drawing Sheets

ITEM HOLDER

PRIORITY CLAIMS

This application claims priority under 35 USC §119 and 120 from U.S. Provisional Patent Application No. 60/214,969 filed on Jun. 29, 2000 and entitled "Item Holder".

FIELD OF THE INVENTION

This invention relates generally to an apparatus for holding various necessary items for people and in particular to an apparatus for holding various necessary items for elderly or forgetful people including, for example, eyeglasses, dentures, hearing aids and the like.

BACKGROUND OF THE INVENTION

A lot of people do not have a good memory and often forget and/or misplace items. This is especially true for elderly people who are often beset by poor memory and forgetfulness. This forgetfulness causes the elderly person to misplace items of importance to the elderly person since the elderly person may place an item in a particular location, but forget the location of the item later. This is especially a problem with various items that are necessary for the elderly person to conduct everyday activities. These necessary items may include eyeglasses (necessary to see), dentures (necessary for eating and talking) and hearing aids (necessary for hearing). If these items are misplaced or lost, the elderly person may have very significant difficulties completing everyday tasks. In addition, an elderly person often has a severely limited fixed income so that the cost of replacing these necessary items is prohibitive. In addition, the time to replace these items means that the elderly person must go without the item for some period of time.

The problem is particularly evident in nursing homes, elderly care facilities and the like. In particular, a nursing home may house hundreds of elderly people who often have cognitive disorders, such as Alzheimer's disease, that severely diminishes the person's memory. Often, a nurse may help the elderly person get ready for bed including removing the elderly person's items, such as eyeglasses, dentures and hearing aids. The nurse may then place these items in some location for safekeeping until the morning. However, in the morning, a different nurse may help the elderly person wake up and get ready for the day and that nurse may not know where the nurse placed the elderly person's items. Even worse, the items are lost and end up in a lost and found box in the nursing home that may contain numerous eyeglasses, dentures and hearing aids.

It is desirable to provide an apparatus that permits these necessary items to be housed in one holder so that the items can be later found and it is to this end that the present invention is directed.

SUMMARY OF THE INVENTION

The holder in accordance with the invention permits a person's necessary items to be stored in a single location so that it is easy to locate the necessary items. The holder also ensures that anyone handling the necessary items knows where to place the items for storage so that the items are not lost. The item holder in accordance with the invention may also include a person identification mechanism so that any person handling the necessary items can readily determine that the necessary items are being placed into the holder for the correct person or patient. The item holder in accordance with the invention may be used both at nursing homes where necessary items, such as eyeglasses, dentures or hearing aids, are often lost or misplaced because there is no obvious place to store the items while the patient is sleeping, as well as at home to help various people keep track of the above necessary items.

In accordance with one aspect of the invention, the item holder may be shaped like the face of a person. The item holder may be painted or otherwise decorated to look like a person's face. The person's face may be of a variety of different colors to represent different races. The item holder may include one or more storage trays/shelves positioned at various locations on the face in order to store the necessary items of the person using the item holder. For example, the item holder may include a shelf or tray adjacent the depiction of the eyes of the face to store eyeglasses, a shelf or tray adjacent each ear for storing the hearing aid for each ear and a shelf or tray adjacent to the mouth on the face for storing the dentures of the person. The item holder may also include a plate on which the person's name and room number (for a nursing home for example) may be displayed.

In accordance with another aspect of the invention, the item holder may be a container that may include separate compartments for storing eyeglasses, dentures, hearing aids and any other necessary items. In accordance with the invention, the compartments for each item may be shaped to indicate the appropriate items that should be placed in the compartment or the bottom of each container may contain a depiction of the item to be placed in the compartment or a symbol representing each item may be placed near each compartment.

In accordance with another aspect of the invention, the item holder for a nursing home may be a container that holds each of the items which is then placed onto or hung from a representation of a figure, such as a doctor or a nurse, wherein the figure may include an area where information about the particular patient using the item holder may be placed, such as the patient's name, the room number of the patient, the name of the aide normally responsible for the patient, the name of the person on the morning and evening shift responsible for the patient, the current date and any other relevant information. The patient information may permit lost or misplaced items to be more easily located since the responsible person may be identified and questioned when an item is misplaced.

Thus, in accordance with the invention, an item holder is provided. The item holder comprises a piece of material constructed in the shape of a face wherein a denture tray is attached near a mouth located on the piece of material wherein a denture may be placed in the tray to be stored. The item holder further comprises an eyeglass tray attached near the eyes located on the piece of material wherein a set of eyeglasses may be placed in the tray to be stored and a hearing aid tray attached near an ear located on the piece of material wherein a hearing aid may be placed on the tray to be stored.

In accordance with another aspect of the invention, an item holder is provided. The item holder comprises a piece of material having a predetermined shape and a denture tray attached near a first location on the piece of material wherein a denture may be placed in the tray to be stored. The item holder further comprises an eyeglass tray attached near a second location on the piece of material wherein a set of eyeglasses may be placed in the tray to be stored, and a hearing aid tray attached near a third location on the piece of material wherein a hearing aid may be placed on the tray to be stored.

In accordance with yet another aspect of the invention, an item holder comprises a first compartment for storing a set of dentures, a second compartment for storing a set of eyeglasses and a third compartment for storing one or more hearing aids. The first, second and third compartments each have a depiction of the item to be stored in the particular compartment to help people remember to store the item in the compartment and remember where the particular item is stored.

DETAILED DESCRIPTION OF A PREFERRED EMBODIMENT

The invention is particularly applicable to a holder for holding various necessary items for an elderly person and it is in this context that the invention will be described. It will be appreciated, however, that the apparatus in accordance with the invention has greater utility since the holder may be used by anyone that frequently misplaces or loses the above necessary items and it may be used with a variety of different necessary items.

Figure 1A:
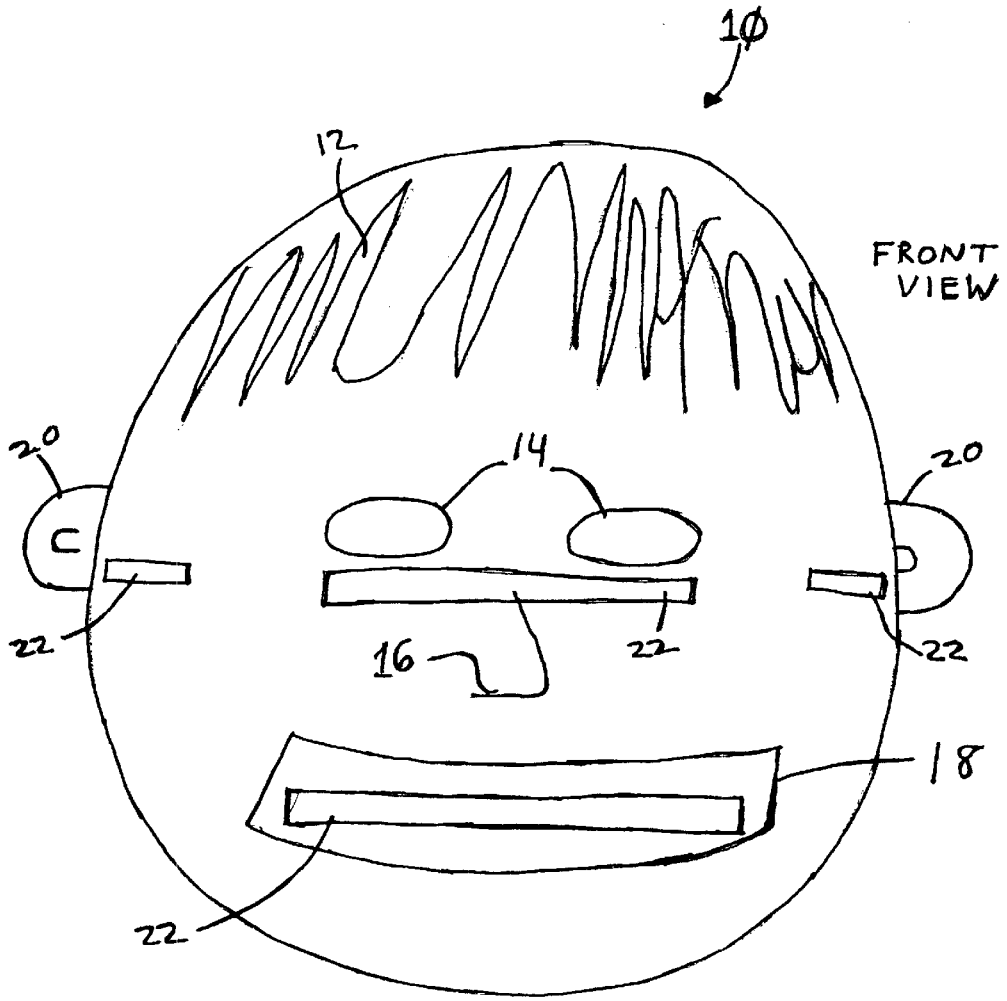
FIGS. 1A and 1B are diagrams illustrating a front view and a top view, respectively, of an example of an item holder in accordance with a first embodiment of the invention.
Figure 1B:
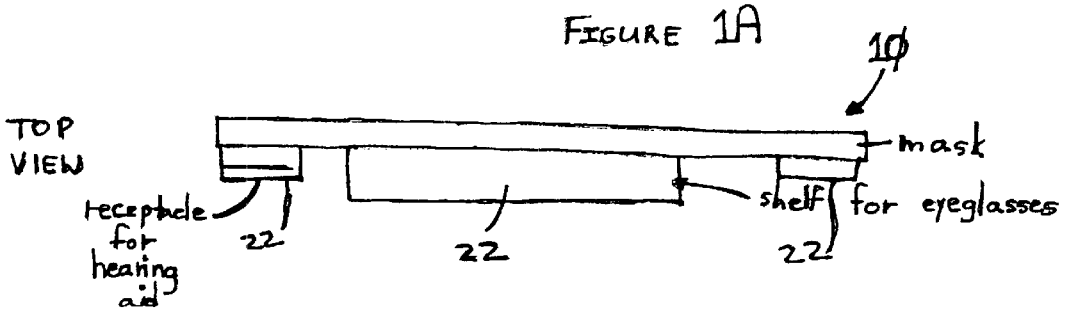

FIGS. 1A and 1B are diagrams illustrating an item holder 10 in accordance with the invention. In particular, the item holder 10 may be any suitable material, such as plastic or wood, shaped as a face so that it is easy for a person or an attendant for an elderly person to determine where to store the person's necessary items, such as dentures, eyeglasses and hearing aids. In accordance with the invention, the item holder may be a variety of different shapes as described in more detail below. In accordance with the first embodiment of the invention, the item holder 10 may be decorated, such as by painting or using different color materials, etc., to create a face. For example, hair 12, eyes 14, nose 16 and a mouth 18 may be placed on the item holder. The item holder may also be decorated so that the face may be of any race. In addition, the item holder 10 may also include a pair of appropriately placed ears 20. Thus, in accordance with the invention, it will be obvious to anyone placing the necessary items into the item holder where those necessary items are stored. To facilitate the storage of the items, the item holder may include a shelf/tray 22 adjacent to each part of the face which represents an item being stored. For example, there may be a shelf for a person's eyeglasses beneath the eyes 14 decorating the item holder, there may be a shelf adjacent each ear 20 for hearing aids and there may be a shelf beneath the mouth 18 of the item holder for storing dentures. Thus, the user of the item holder, such as an elderly person, or an aide taking care of an elderly or disabled person, may easily determine where the user's items such as eyeglasses, dentures and hearing aids may be safely stored so that the items are not misplaced or damaged.

To help identify the person whose items are stored on the item holder 10, the item holder may include space (not shown in FIGS. 1A and 1B) where various information about the person may be placed. For example, information may be removable written in the space or the information may be permanently scribed or etched into the item holder to customize the item holder of the particular person. In accordance with the invention, the information about the person may include the name of the person, the current room assignment of the person (for a nursing or hospital setting), the current person assigned to care for the person during the day and night and any other relevant information. The person's information may permit a misplaced item to be more easily located. The item holder 10 permits even a person with limited memory or poor eyesight to be able to place the items in the proper storage trays/shelves so that the items are not misplaced or lost. In accordance with the invention, the item holder 10 may be attached to a wall using an attachment means, such as a nail or picture hanger, or may rest on a table or other flat surface provided that the bottom surface of the item holder 10 is flat. Now, a second embodiment of the item holder 10 in accordance with the invention will be described.

Figure 2A:
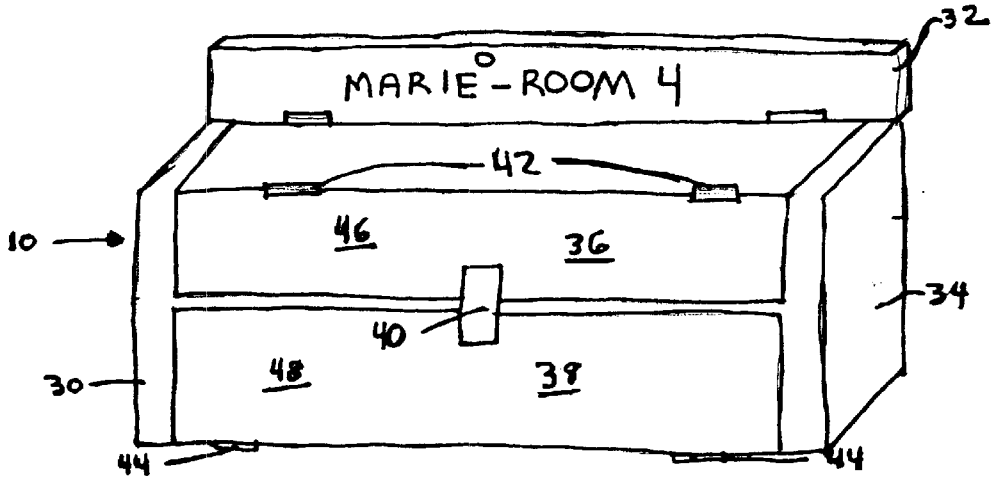
FIGS. 2A, 2B and 2C are diagrams illustrating perspective views of an item holder in accordance with a second embodiment of the invention wherein the various compartments for the necessary items are shown.
Figure 2B:
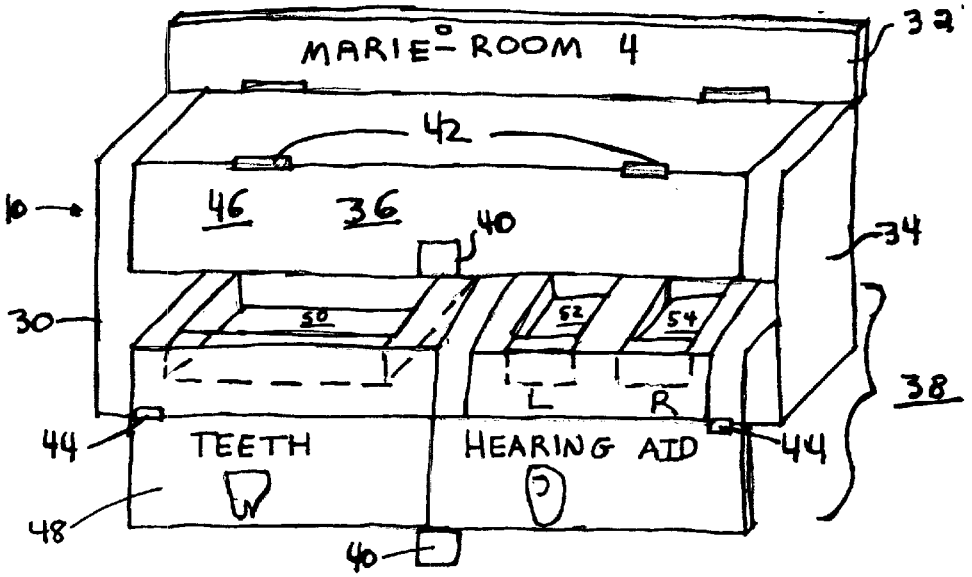
Figure 2C:
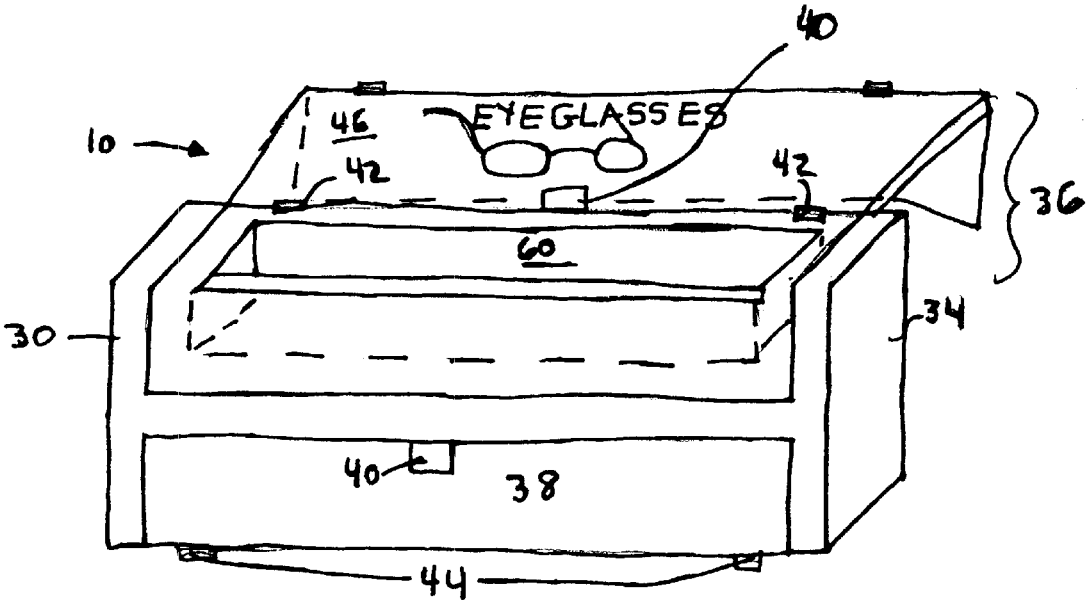

FIGS. 2A–2C illustrate a second embodiment of the item holder 10 in accordance with the invention. In this embodiment, the item holder 10 may be a container 30 that may be rectangularly shaped, but may also be any other shape. The container 30, as shown in FIG. 2A, may include a portion 32 in which various information about the owner of the items placed into the item holder may be displayed as described above. In the example shown, the person's name and current room assignment may be temporarily or permanently affixed to the item holder. The container 30 may also include an outer housing 34 that houses the one or more compartments that store the items while not being worn by the user. The container may further include an upper portion 36 and a lower portion 38 that are connected together by an attachment mechanism 40, such as a locking mechanism. The locking mechanism secures the upper portion 36 and the lower portion 38 together and ensures that the items stored in the container 30 do not fall out even if the item holder 30 is dropped or falls. The attachment mechanism in accordance with the invention may be any type of mechanism that holds the upper portion 36 and the lower portion 38 together. The container 30 may further include a first set of hinges 42 that permit a door 46 of the upper portion 36 to open to reveal one or more item storage compartments as described below with reference to FIG. 2C and a second set of hinges 44 that permit a door 48 of the lower portion to be opened to reveal one or more item storage compartments as will now be described with reference to FIG. 2B.

FIG. 2B illustrates the item holder 30 when the door 48 of the lower portion 38 has been opened using the hinges to reveal the one or more item storage compartments. In this example, the lower portion may include a first compartment 50, a second compartment 52 and a third compartment 54 that may be square receptacles in the example shown. In accordance with the invention, however, the compartment may be any shape including shaping each compartment like the item being stored in the compartment or the part of the body where the item is located so that the eyeglass compartment may be shaped like eyeglasses, the denture compartment may be shaped like a mouth and the hearing aid compartments may be shaped like ears. In the example shown, to identify the correct compartment for each item, the name of the item to be stored in the particular compartment and/or a pictorial representation of the part of the body or the item may be displayed on the inside portion of the door 48 adjacent the appropriate compartment. Thus, in the example shown, a tooth picture and the word "teeth" is located adjacent to the first compartment 50 for storing dentures and a picture of an ear and the name "hearing aids" may be located adjacent the second and third compartments 52, 54 for storing the hearing aids of the user. For the hearing aids, the second and third compartments 52, 54 may be further identified as storing the right or left hearing aid. In accordance with the invention, instead of the words and pictorial representations shown in FIG. 2B, the item holder may include compartments shaped like each of the items or the parts of the body as described above or each compartment may include the words and/or pictorial representation etched into the bottom of the compartment. Now, the upper portion 36 will be described in more detail.

FIG. 2C illustrate the item holder 10 with the door 46 of the upper portion 36 opened to reveal a fourth compartment 60. In this example, the fourth compartment 60 may store the eyeglasses of the user. As described above, the inside portion of the door 46 may include a word and/or pictorial representation of the item, such as "eyeglasses" and a picture of a pair of eyeglasses in this example. The compartment 60 may also be shaped like a pair of eyeglasses or the word and/or picture may be etched into the bottom of the compartment as described above. Thus, in accordance with the invention, the user's eyeglasses, dentures and hearing aids in this example may be stored in the item holder so that the items are not lost or misplaced. As with the previous embodiment, the container 30 may be attached to a wall by a securing means, such as a nail, or it may rest on a flat surface such as a desk, a table, nightstand or the like. Now, a third embodiment of the item holder in accordance with the invention will be described.

Figure 3A:
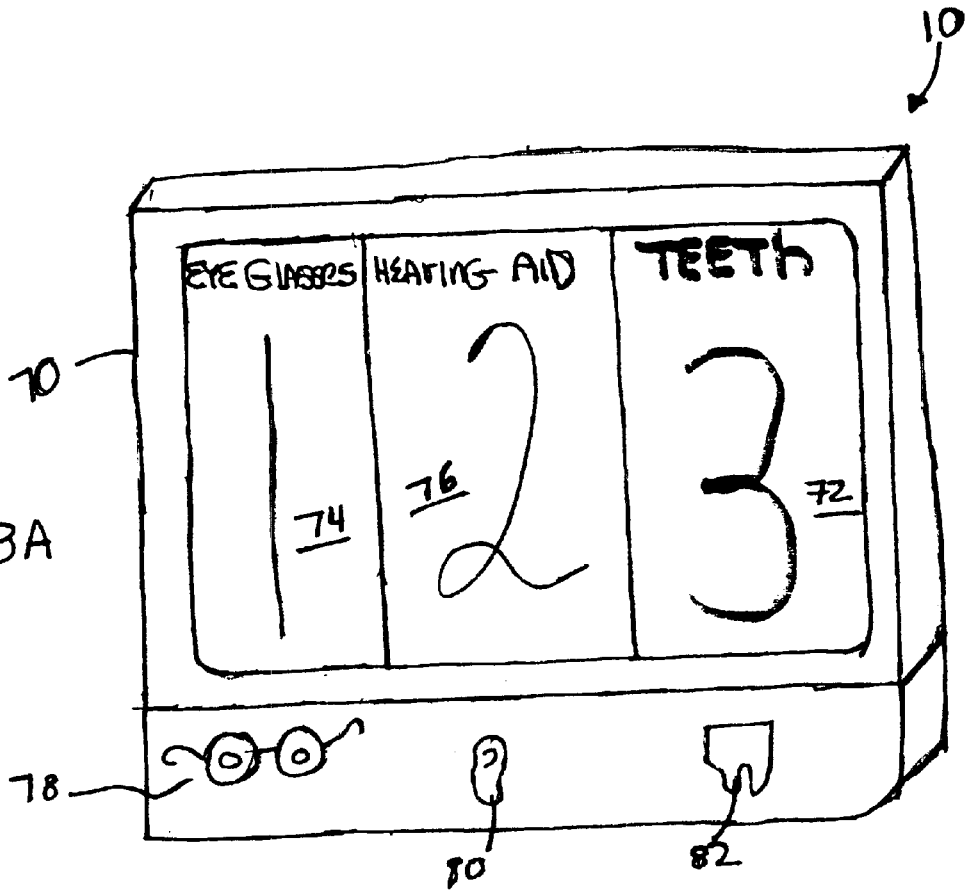
FIGS. 3A and 3B are diagrams illustrating a third embodiment of the item holder in accordance with the invention.
Figure 3B:
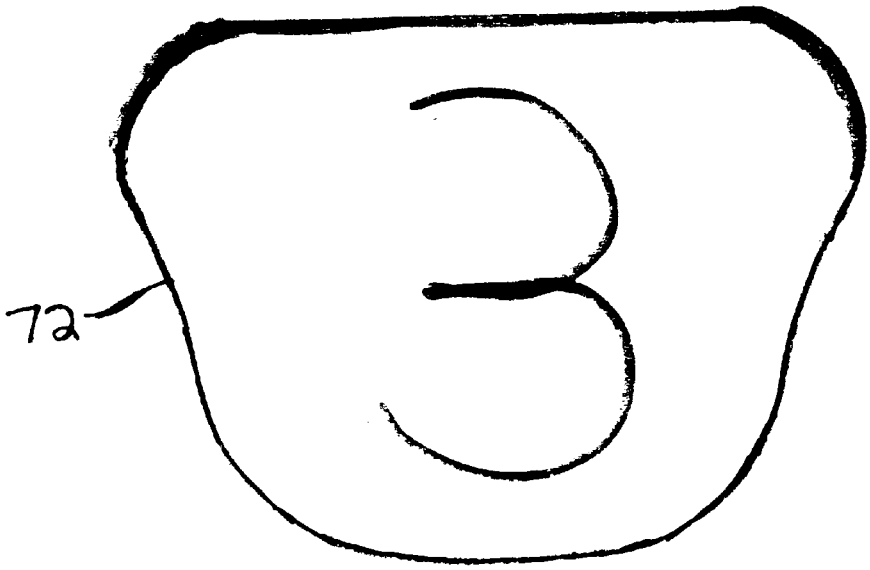

FIGS. 3A and 3B are diagrams illustrating a third embodiment of the item holder 10 in accordance with the invention wherein the item holder 10 may comprise a container 70 that may include one or more storage compartments which are adjacent to each other as shown in FIG. 3A. The compartments may be of any shape such as the rectangles shown in FIG. 3A or, as shown in FIG. 3B, a compartment 72 may be shaped like the item that is going to be stored in the compartment. In the example shown in FIG. 3B, the teeth compartment may be shaped like a set of dentures.

Returning to FIG. 3A, the item holder 10 may include a first compartment 74, a second compartment 76 and the third compartment 72. In this embodiment, the first compartment 74 may be used for storing eyeglasses and may be labeled as "1" and "eyeglasses". To further aid in the recognition of which item is stored in the compartment, a pictorial representation 78 of eyeglasses may be located adjacent the compartment (e.g., beneath the compartment in this example). The second compartment 76 may be used for storing hearing aids, may be labeled with "2" and "hearing aids" and may include an adjacent pictorial representation 80 of an ear. The third compartment 72 may be used for storing the dentures of the user, may be labeled with "3" and "teeth" and may include a pictorial representation 82 of a tooth for easy identification. As described above, each of the compartments may be shaped to be similar to the item being stored to make it still easier for a user to place the item in its proper storage compartment. As above, this embodiment of the item holder may be affixed to a wall or rest on a flat surface. Now, another embodiment of the item holder will be described.

Figure 4:
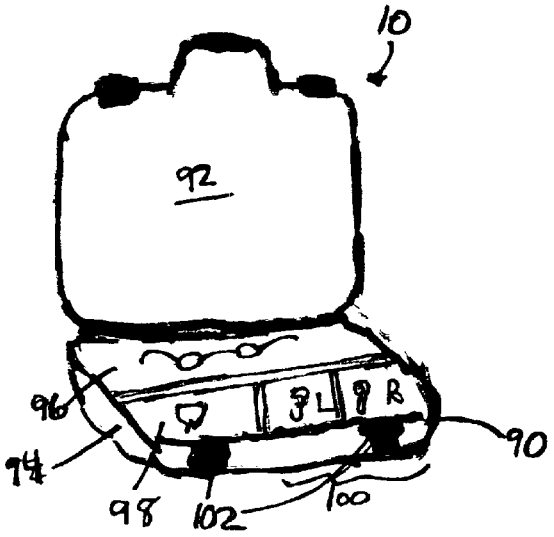
FIG. 4 is a diagram illustrating a fourth embodiment of the item holder in accordance with the invention.

FIG. 4 is a diagram illustrating a fourth embodiment of the item holder 10 in accordance with the invention wherein the item holder may be a hard plastic case 90 having an upper portion 92 and a lower portion 94 that may be connected together in a clam-shell manner as is well known. In this embodiment, the upper portion 92 may be the top of the case made of a see-through plastic material so that the items stored in each compartment may be viewed by the user of the item holder. The lower portion 92 may be made of a hard opaque plastic material and may include one or more separate storage compartments for storing the various items as described above. In the example shown in FIG. 4, the compartments may include a eyeglasses compartment 96, a teeth compartment 98 and one or more hearing aid compartments 100. As described above, each compartment may have text and/or a pictorial representation associated with it that identifies the item to be stored in the compartment. The item holder 10 in FIG. 4 may also include a pair of latches 102 that secure the upper portion 92 to the lower portion 94 when the latches are locked to ensure that the items in the item holder do not fall out of the item holder. This embodiment of the item holder may typically rest on a flat surface. Now, a fifth embodiment of the item holder in accordance with the invention will be described.

Figure 5:
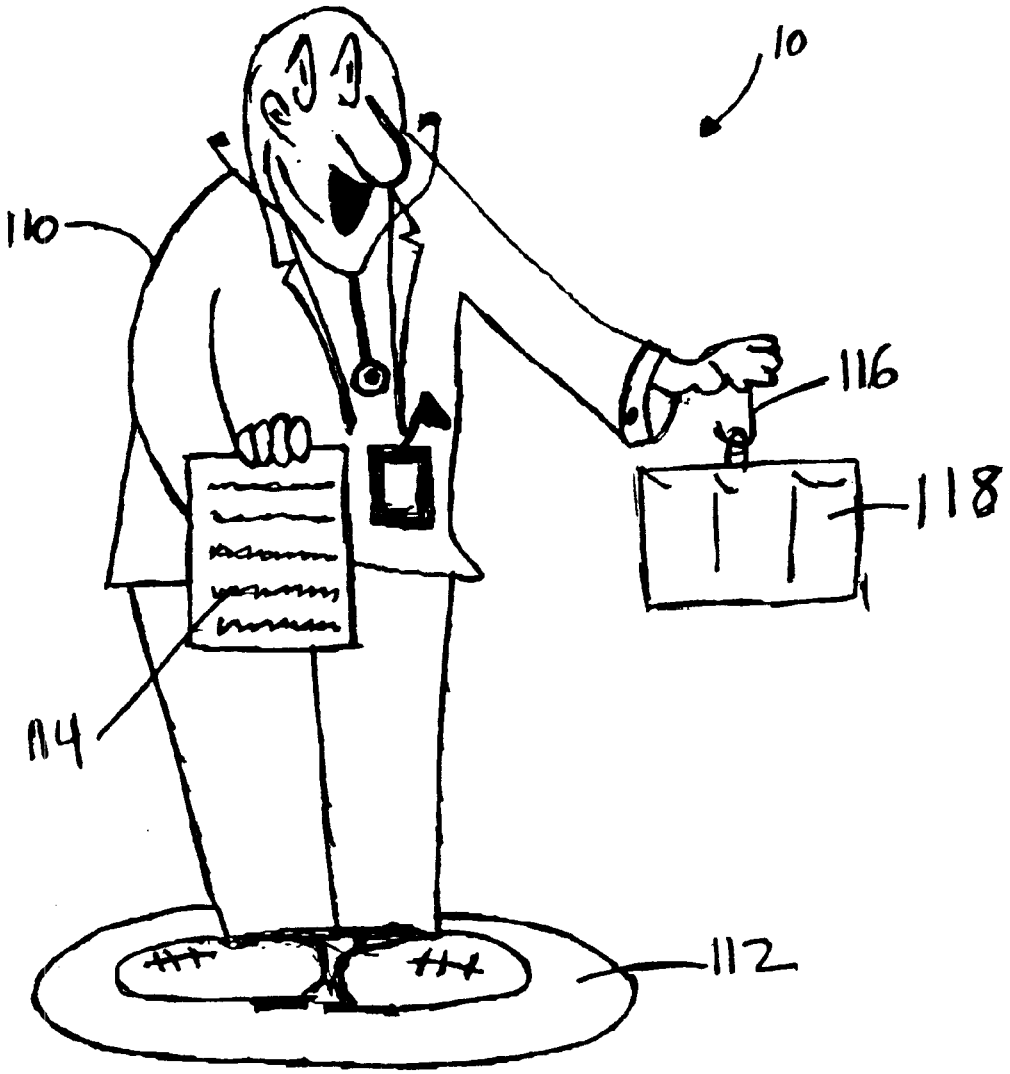
FIG. 5 is a diagram illustrating a fifth embodiment of the item holder in accordance with the invention.

FIG. 5 is a diagram illustrating a fifth embodiment of the item holder 10 in accordance with the invention. In this embodiment, the item holder 10 may include a figure 110 that stands on a base 112 on the ground. In the example shown, the figure may be a representation of a doctor or nurse, but may also be any other figure. The FIG. 110 may hold an erasable patient information display area 114 in one hand and a hook 116 in the other hand that may be used for hanging an item container 118 in accordance with the invention. In particular, each of the above item holder embodiments may be modified so that it may be hung from the hook 116 shown in FIG. 5. An example of another item container 118 that may be hung from the hook will be described below with reference to FIGS. 6A and 6B.

The information display area 114 may include various information about the patient, such as the name of the patient, the room number of the patient, the name of the aide for the patient (both day and night) and the current date. The information may be used to identify the patient as needed or to track down misplaced items of the patient since the people responsible for the patient may be questioned.

Figure 6A:
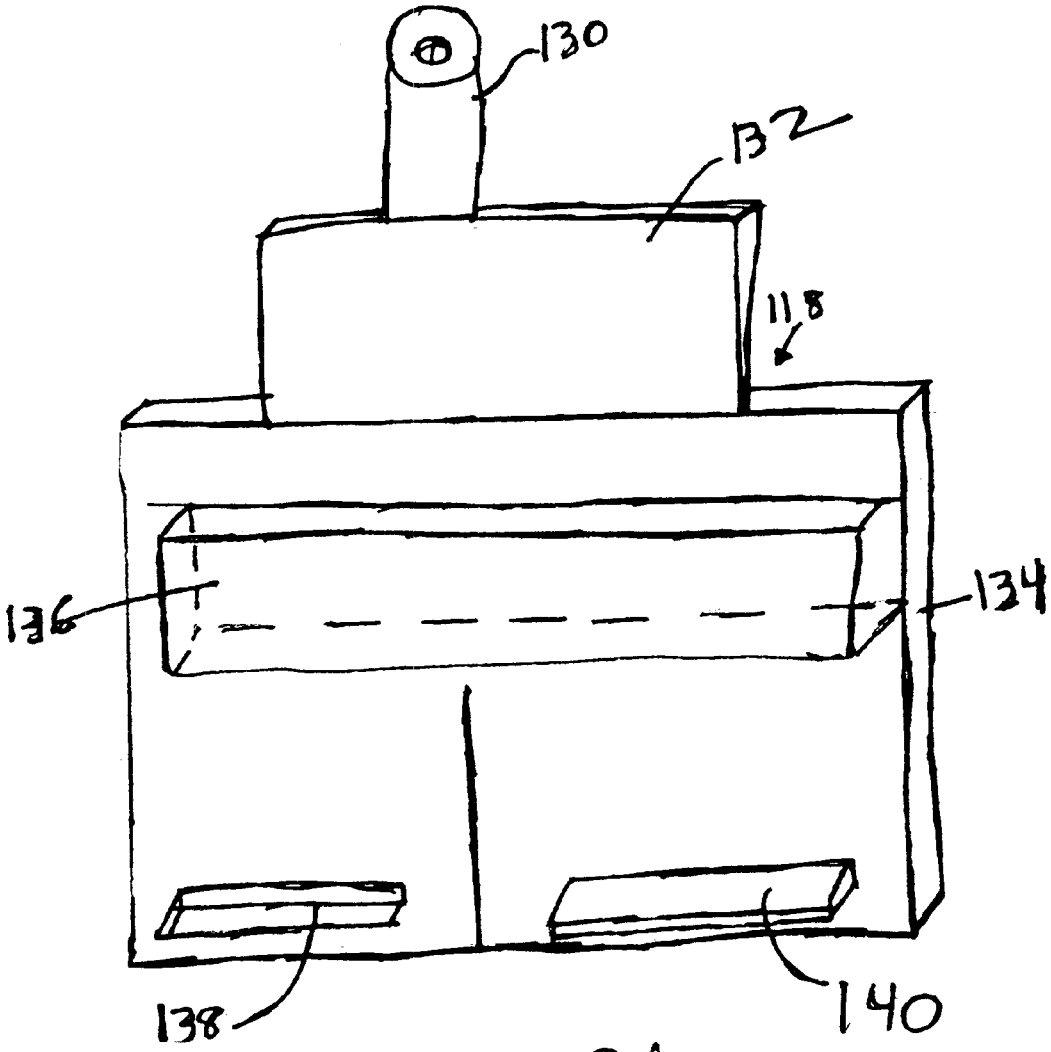
FIGS. 6A and 6B are diagrams illustrating more details of the fifth embodiment in accordance with the invention.
Figure 6B:
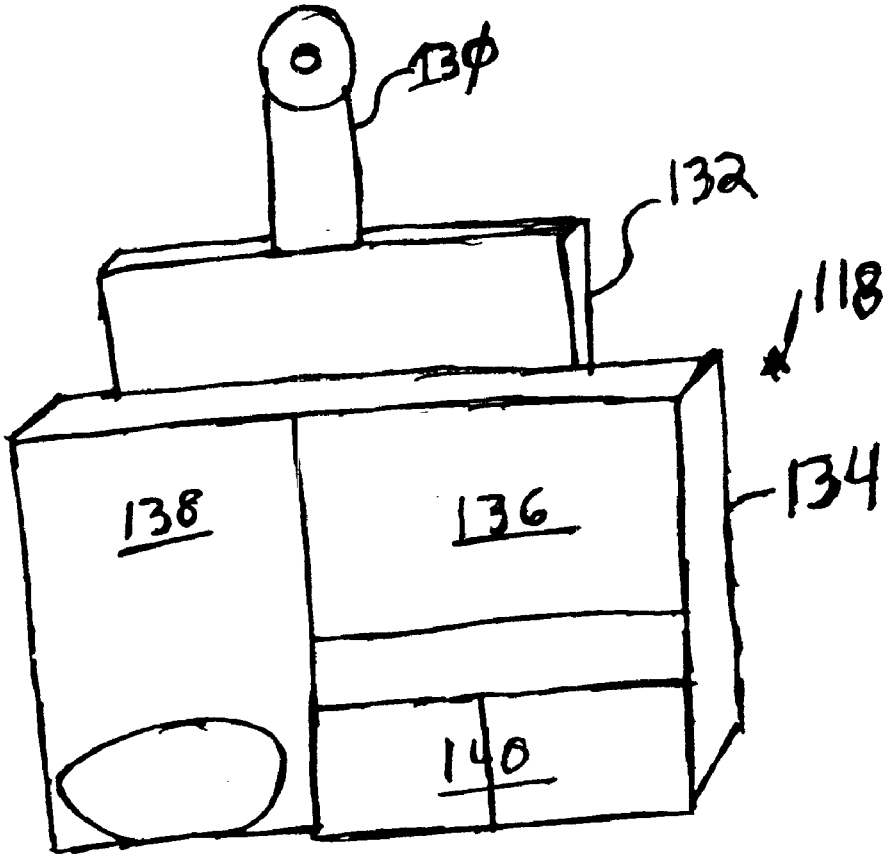

An example of the item container 118 is shown in FIGS. 6A and 6B although the other embodiments of the item holder may also be adapted to be hung from the hook 116 as described above. FIG. 6A shows an item container 118 that may include a handle portion 130 that hangs on the hook of the figure, a name plate portion 132 that may be painted or otherwise decorated with the name of the owner of the items stored in the item container and any other relevant information and a container portion 134. The container 134 may contain one or more open storage compartments for storing the items of the user. For example, the container 134 may include a glasses compartment 136, a teeth compartment 138 and a hearing aids compartment 140. In this example, the compartments may be open receptacles for the items that otherwise do not have a locking cover. In the example shown in FIG. 6B, the compartments 136–140 are closed so that the items may be placed into the compartment and a lid may be closed to ensure that the items do not fall out of the compartments.

While the foregoing has been with reference to a particular embodiment of the invention, it will be appreciated by those skilled in the art that changes in this embodiment may be made without departing from the principles and spirit of the invention, the scope of which is defined by the appended claims.

What is claimed is:

1. An item holder comprising:

a piece of material constructed in the shape of a face;

a denture tray attached near a mouth located and depicted on the piece of material wherein a denture may be placed in the tray to be stored;

an eyeglass tray attached near the eyes located and depicted on the piece of material wherein a set of eyeglasses may be placed in the tray to be stored; and a hearing aid tray attached near an ear located and depicted on the piece of material wherein a hearing aid may be placed on the tray to be stored.

2. The item holder of claim 1 further comprises a second hearing aid tray attached near a second ear located and depicted on the piece of material wherein a second hearing aid may be placed on the tray to be stored.

3. An item holder comprising:

a piece of material having a predetermined shape;

a denture tray attached near a first location on the piece of material wherein the denture tray has an illustration of a denture so that a denture may be placed in the tray to be stored;

an eyeglass tray attached near a second location on the piece of material wherein the eyeglass tray has an illustration of a pair of eyeglasses so that a set of eyeglasses may be placed in the tray to be stored; and a hearing aid tray attached near a third location on the piece of material wherein the hearing aid tray has an illustration of a hearing aid so that a hearing aid may be placed on the tray to be stored.

4. The item holder of claim 3 further comprising a second hearing aid tray attached near a fourth location on the piece of material wherein the second hearing aid tray has an illustration of a hearing aid so that a second hearing aid may be placed on the tray to be stored.

5. An item holder, comprising:

a first compartment for storing a set of dentures, the first compartment being shaped to fit a set of dentures so that a set of dentures will fit into the first compartment;

a second compartment for storing a set of eyeglasses, the second compartment being shaped to fit a set of eyeglasses so that a set of eyeglasses will fit into the second compartment;

a third compartment for storing one or more hearing aids, and wherein the first, second and third compartments each have a depiction of the item to be stored in the particular compartment to help people remember to store the item in the compartment and remember where the particular item is stored.

6. The item holder of claim 5, wherein the third compartment further comprises a first hearing aid compartment being shaped to fit a single hearing aid and a second hearing aid compartment being shaped to fit a single hearing aid so that each hearing aid is stored in a separate compartment.

7. The item holder of claim 6, wherein the first hearing aid compartment has an illustrating indicating that a left hearing aid is to be stored in the first hearing aid compartment and wherein the second hearing aid compartment has an illustrating indicating that a right hearing aid is to be stored in the second hearing aid compartment.

* * * * *